US005177988A

United States Patent [19]

Bushnell

[11] Patent Number: 5,177,988

[45] Date of Patent: Jan. 12, 1993

[54] SECURITY LOCK MECHANISM INCORPORATING HYDRAULIC DEAD LOCKING

[76] Inventor: Raymond B. Bushnell, 323 Fantasia, San Antonio, Tex. 78216

[21] Appl. No.: 738,314

[22] Filed: Jul. 31, 1991

[51] Int. Cl.[5] ..... E05B 47/00

[52] U.S. Cl. ..... 70/279; 70/175; 292/144; 292/252

[58] Field of Search ..... 70/279, 104, 129, 132, 70/134, 144, 150, 175, 470, 478, DIG. 48, DIG. 50; 292/144, 201, 171, 252

[56] References Cited

U.S. PATENT DOCUMENTS

| | | | |
|---|---|---|---|
| 753,544 | 3/1904 | Cassidy | 292/252 |
| 1,029,403 | 6/1912 | Schlatterer | 70/175 X |
| 2,139,193 | 12/1938 | Lamothe et al. | 292/252 |
| 2,530,628 | 11/1950 | Pivero | 292/144 X |
| 2,535,947 | 12/1950 | Newell | 292/252 X |
| 2,709,610 | 5/1955 | Chandler | 292/144 X |
| 2,786,701 | 3/1957 | Povlich | 292/144 |
| 2,832,623 | 4/1958 | Golemon | 292/252 X |
| 3,843,174 | 10/1974 | Bogunovich et al. | 292/144 X |
| 4,099,752 | 7/1978 | Geringer | 292/144 |
| 4,127,966 | 12/1978 | Schmidt | 292/252 X |
| 4,169,616 | 10/1979 | Peterson | 70/129 X |
| 4,557,121 | 12/1985 | Charlton | 70/279 |
| 4,572,011 | 2/1986 | Mauchlen | 292/252 X |
| 4,881,766 | 11/1989 | Schmidt et al. | 70/279 X |

FOREIGN PATENT DOCUMENTS

| | | | |
|---|---|---|---|
| 358703 | 1/1962 | Switzerland | 70/175 |

*Primary Examiner*—Renee S. Luebke
*Assistant Examiner*—Suzanne L. Dino
*Attorney, Agent, or Firm*—Gunn, Lee & Miller

[57] ABSTRACT

A locking system for a dead bolt and slam bolt locking of a movable door to a stationary keeper comprises a lock housing defining a cylinder chamber having an opening alignable with a keeper recess in the closed position of the door. A spherical locking bolt is mounted on a piston which is slidably and sealably movable in the cylinder chamber between an inner non-locking position and an outer locking position. The interior of the cylinder chamber is filled with a non-compressible fluid by outward movement of the piston and a normally closed check valve prevents exhaust of such fluid to produce a dead lock conditon. The check valve is alternatively opened by a manual key or by remotely controlled energization of a solenoid.

21 Claims, 2 Drawing Sheets

SECURITY LOCK MECHANISM INCORPORATING HYDRAULIC DEAD LOCKING

BACKGROUND OF THE INVENTION

1. Field of the Invention

The present invention relates to a security lock mechanism for doors, gates and the like of the type employed for regulating access to secured areas, and more particularly to an improved security lock mechanism adapted both for dead lock and slam lock operation.

2. Summary of the Prior Art

Lock mechanisms for doors and gates employed for regulating access to secured areas have been the subject of many prior art patents. It is recognized in this art that any security mechanism must have the capability of assuming a dead lock position, yet also be capable of slam lock operation. The term dead lock position means literally that the door or gate is positively locked against movement in response to any force applied to the door or gate. Operation of the lock mechanism from the dead lock position to an open position normally requires the insertion and turning of key or, for remotely controlled lock systems, the energization of a solenoid which effects retraction of the locking bolt from the dead lock position.

By slam lock position, the prior art patents, such as U.S. Pat. No. 4,913,475 issued to BUSHNELL et al., refer to a locking mechanism which will permit the gate or door to be slammed to a closed position even though the locking bolt is positioned in its locking position. Slam locking is generally accomplished by a camming action exerted on the locking bolt by the striker plate. The conventional mechanism provide a camming surface on either the striker plate or the locking bolt which is engaged by contact of these two elements to exert a retraction force on the locking bolt sufficient to permit the gate or door to reach its closed position, whereupon the locking bolt resumes its extended position to lock the door or gate in the closed position.

The locking mechanism of the prior art have predominately involved complex mechanical linkages, particularly when a remotely controlled solenoid is incorporated in the locking mechanism. Such linkages are subject to wear and have a relatively short life when employed on a door that is frequently locked and unlocked. More importantly, prior art locking mechanisms are subject to failure to shift to an open position when any significant force is applied to the door which the lock mechanism is securing, whether that force be a lateral, or a vertical force. As is well known, locking systems used in jail cells are particularly subject to this type of abuse by the occupant arbitrarily applying a lateral or vertical force to the door at the time that the locking mechanism is being remotely operated by a guard who cannot readily ascertain that the prisoner is attempting to foul up the operation of the lock. Lateral forces on the door as low as 15 lbs. have been found to completely bind up many conventional cell door locking mechanisms and prevent unlocking. This is a serious defect in prior art mechanically operated locking systems. If one or more panic stricken individuals seek to escape through the locked door, they will kick, and push laterally on the door with sufficient force to bend the locking mechanism and prevent the unlocking and opening of the door.

Pneumatic operation of a locking system has been proposed in U.S. Pat. No. 4,691,948 issued to AUSTIN, JR. et al. Such locking system uses compressed air and a solenoid controlled valve to effect movement of the locking bolt to and from a locking position with respect to a striker plate. This system is, of course, subject to immediate failure in the event that pressured air becomes unavailable for any reason. In such event, resort must be had to a key to manually effect the movement of the locking bolt to and from its locked and open positions.

In remotely controlled locking systems, it is highly desirable that a reliable indication be provided as to whether the locking bolt is positioned in its extended locked position or its retracted, unlocked position. A variety of mechanisms have heretofore been proposed to accomplish this objective, but none have provided a highly reliable yet economical system for indicating the locking bolt position.

There is, therefore, an established need in the field of security lock systems for a locking arrangement that will successfully operate even when very substantial lateral or vertical forces are applied to the locked door or gate. Moreover, a locking system is required for remote operation which does not rely upon the existence and proper operation of a source of pressured air.

SUMMARY OF THE INVENTION

It is an object of the present invention to provide an improved security lock mechanism of the type generally referred to above and adapted for both dead lock and slam lock operation while providing reliable operation over extended periods of time, either by key or a remotely controlled solenoid, and overcoming the aforementioned disadvantages of the prior art systems.

A locking system embodying the method and apparatus of this invention contemplates the mounting of the locking bolt on a piston which slidably and sealably cooperates with a cylinder chamber provided in the lock housing to move the locking bolt between a projecting locking position in engagement with a striker plate, or to a retracted position wherein the locking bolt does not extend beyond the face of the lock housing. A spring biases the piston to its locking position. The cylinder chamber in which the piston is mounted is normally filled with a non-compressible fluid. Such cylinder chamber is in communication with a fluid passage leading to a fluid reservoir chamber which is also defined within the lock housing. Sufficient fluid is inserted so as to fill the cylinder chamber, the fluid passage, and at least a portion of the fluid reservoir chamber in order to maintain fluid in the fluid passage when the piston is moved to its locking position. A check valve is mounted in the fluid passage and cooperates with a valve seat surrounding the fluid passage opening to prevent flow of fluid from the cylinder chamber to the fluid reservoir chamber, thus creating a fluid blocking of the locking bolt in its locked position, and creating a dead lock condition for the locking bolt.

To release the locking bolt from its dead lock position, the check valve is opened to permit fluid flow from the cylinder chamber into the fluid reservoir chamber. Such flow then permits the piston carrying the cylinder lock to move to a retracted position in the cylinder, permitting the unlocking of the locking bolt. In accordance with this invention, such movement of the locking bolt is produced through the manual application of an opening force to the door and the utilization of a hardened steel ball as the locking bolt. Such spherical locking bolt cooperates with a semi-spherical recess defined in the striker plate, and the opening of the check valve followed by the application of an opening force to the door will result in the camming of the spherical locking bolt and its supporting piston inwardly in the cylinder chamber to release the locking bolt from the striker plate.

The same action is repeated whenever the door is slammed to its closed position with the spherical locking bolt projecting from the lock housing and the check valve in its open position. As previously mentioned, the spring normally maintains the locking bolt in such projecting position. So long as the check valve is maintained in its open position, the slamming of the door produces a camming action by the striker plate against the spherical locking bolt to force the bolt inwardly and permit the door to fully close, following which the spring bias on the piston returns it to a locked position, but is not a dead lock position until the opening force is removed from the check valve to close the fluid passage between the cylinder chamber and the fluid reservoir chamber.

The operation of the check valve may be accomplished either by a key manually inserted in a conventional lock set assemblage to effect the turning of a cylindrical member which is connected by a linkage to the stem of the check valve. Alternatively, a solenoid may be mounted in the lock housing to permit the remote operation of the check valve to an open position. The core of such solenoid is preferably connected by a suitable linkage to the same cylindrical member as employed for the key unlocking operation and such cylindrical member will turn to effect the shifting of the stem of the check valve to a closed position, thus converting the lock into its dead lock condition.

A further feature of this invention is the utilization of a magnetic band surrounding the piston portion of the spherical locking bolt assemblage to indicate, at a remote location, the actual position of the locking bolt. The position of the magnetic band is detected by a conventional magnetic detector mounted in an annular groove provided in the cylinder wall of the chamber. The proximity of the magnetic ring to the magnetic detector will provide a signal at a remote location indicating whether the lock is in its locked or unlocked position. Obviously, a lock embodying this invention will always be in its extended locking position unless it is deliberately tampered with to restrain the spherical locking bolt in a retracted position relative to the lock housing.

In accordance with this invention, the check valve is constructed in such manner as to constitute a two stage pressure relief and flow valve. In the initial movement of the check valve from its closed position, a limited flow passage is provided for the fluid. The first stage requires a small force to be applied to the stem of the check valve assembly. Such initial flow, however, has the effect of reducing whatever pressure existed in the cylinder chamber so that a second stage of movement of the check valve assembly is accomplished against a lower back pressure, hence permitting the check valve assembly to be readily moved to its fully open position wherein a large flow area is provided for fluid to flow from the cylinder chamber into the fluid reservoir chamber.

Further objects and advantages of the invention will be readily apparent to those skilled in the art from the following detailed description, taken in conjunction with the annexed sheets of drawings, on which is shown a preferred embodiment of the invention.

DETAILED DESCRIPTION OF THE PREFERRED EMBODIMENT

Figure 1:
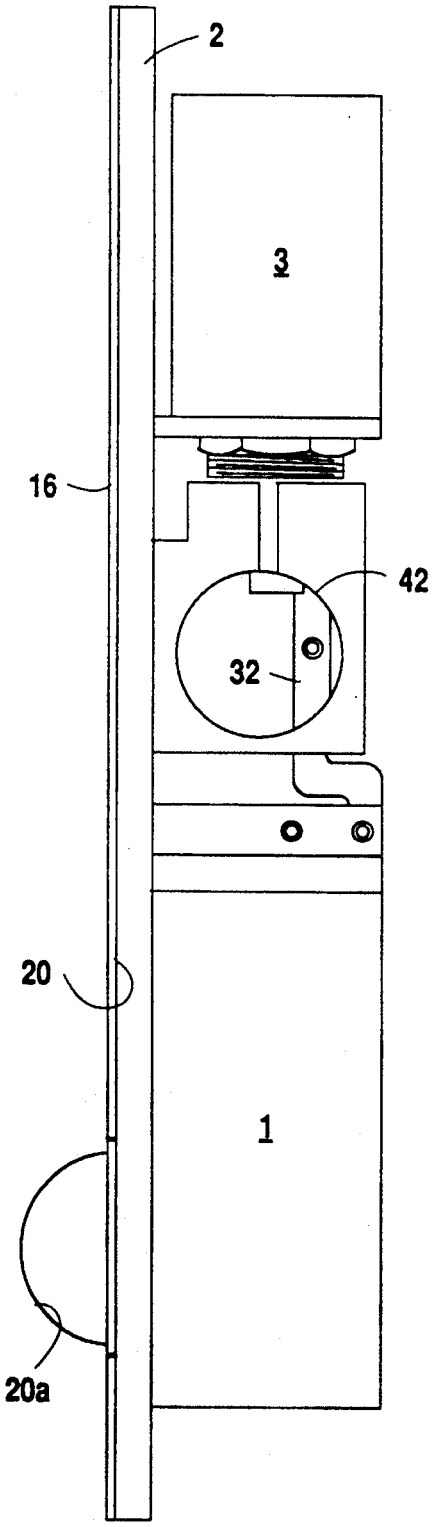
FIG. 1 is a side elevational view of a lock housing embodying this invention shown in cooperative relationship to a striker plate.

Referring to FIG. 1, an elongated housing 1, preferably having a generally rectangular cross section is provided for mounting on a plate 2 by which the housing is secured in the end face of a door frame with a cooperatively placed door, gate or other closure which is moveable about a vertical pivot and requires security locking in a dead bolt position, yet can be unlocked manually by a key or remotely by the energization of a solenoid 3. The lock housing 1 may be mounted in either the end face of the door frame or the end face of the door itself, depending upon the requirements of each individual installation. In the preferred embodiment, the lock housing will be mounted in the door frame.

Solenoid 3 has a threaded bottom end **3*a* which is engaged in a horizontal plate 2*a* which is welded or otherwise rigidly secured to the rear face of the mounting plate 2. Solenoid 3 includes conventional coils (not shown) which surround a core 3*b*** which is axially movable in an upward direction upon energization of the solenoid coils.

Figure 2:
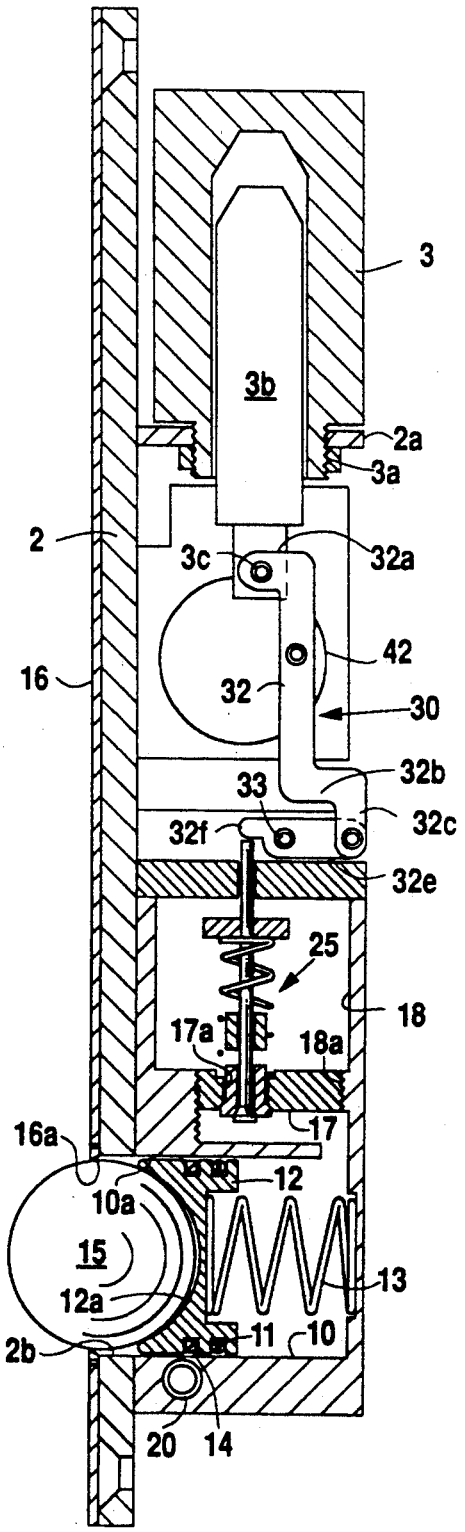
FIG. 2 is a sectional view taken on a vertical plane passing through the center vertical axis of the lock housing. In this view, the mechanism for operating the locking bolt is shown in its dead lock position.

Referring to FIG. 2, the vertically elongated lock housing 1 is suitably rigidly secured to the mounting plate 2, as by bolts or welding, and defines, at its lower end, a horizontal axis, cylindrical chamber 10 which is coaxially aligned with a corresponding cylindrical opening **2*b* in the mounting plate 2. An actuating piston 12 is slidably and sealably mounted within the cylinder chamber 10 by an annular seal 11. Additionally, a magnetized band 14 is mounted in an annular groove provided on the piston 12** for a purpose to be hereinafter described.

The front face **12*a* of the piston 12 is utilized to mount a locking bolt which, in accordance with this invention, preferably comprises a hardened steel ball 15 made of the same material as high quality ball bearings, such as a chrome molybdenum steel alloy. To efficiently mount the ball 15, the front face 12*a* of piston 12 is preferably formed as a spherical segment surface. The ball 15 is retained within the cylindrical opening 10 by a cover plate 16 which is secured to the front face of the mounting plate 2 by any conventional means and has a circular opening 16*a* co-axially aligned with the cylinder bore 10 but having a smaller diameter so as to retain the ball 15 within the cylindrical chamber 10**.

The piston 12 is continuously biased outwardly relative to the cylindrical bore 10 by a compression spring 13. Thus, the spherical locking bolt 15 is normally positioned in projecting relationship beyond the cover plate 16 to engage a spherical segment recess **20*a* provided in a striker plate 20 which is conventionally secured to the door or gate which is to be locked (FIG. 1**).

Figure 4:
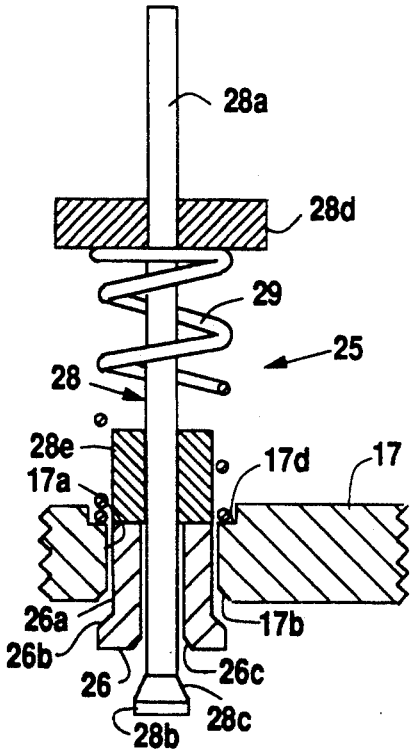
FIG. 4 is an enlarged scale view of the check valve, showing the elements thereof in their open position.

The upper end of the lock housing 1 defines a fluid reservoir chamber 18 which is above the cylinder chamber 10. Reservoir chamber 18 has vertical axis threads 18*a* provided in its lower end to receive a check valve mounting ring 17 which has a vertical passage 17*a* therethrough to provide communication between the cylinder chamber 10 and the fluid reservoir chamber 18. A check valve assembly 25 is mounted within the fluid passage 17*a* to selectively control the passage of fluid from cylinder chamber 10 to reservoir chamber 18. In accordance with this invention, and as best shown in FIG. 4, the check valve assembly 25 comprises a sleeve valve element 26 having a cylindrical body portion 26*a* of lesser diameter than the fluid passage 17*a* and, at its lower end, being radially enlarged to define an external conical sealing surface 26*b* which is cooperable in sealing relationship with an internal conical sealing surface 17*b* provided at the bottom end of the fluid passage 17*a*. Thus, when the sleeve valve 26 is moved upwardly to engage the external sealing surface 26*b* and the conical sealing surface 17*b*, the effective flow passage through the check valve 25 is reduced to the bore area of the sleeve valve 26.

A poppet valve 28 is provided having an elongated stem portion 28*a* extending vertically upwardly through the bore of sleeve valve 26 and having an enlarged head 28*b* formed on its bottom end and defining a conical sealing surface 28*c* which is engageable with an internal conical sealing surface 26*c* formed on the bottom end of the sleeve valve 26. Thus, when the poppet valve 28 is moved upwardly, it will effect a sealing engagement with the sleeve valve 26 and will also carry the sleeve valve upwardly into sealing engagement with the internal seal 17*b* surrounding the fluid passage 17, hence effectively closing such fluid passage. The greater the fluid pressure differential between the cylinder chamber 10 and the reservoir fluid chamber 18, the greater will be the upward force exerted on the sleeve valve 26 and poppet valve 28, thus providing assurance against any leakage of fluid through the check valve 25 when a high pressure differential is produced in the cylinder chamber 10 by door opening forces exerted on the spherical locking bolt 15.

Check valve assembly 25 is biased upwardly by a spring 29 which surrounds the poppet valve stem 28*a*. Spring 29 operates between an upwardly facing surface 17*d* formed in the check valve mounting element 17 and an abutment 28*d* secured to the upper portions of the stem 28*a* of the poppet valve 28. Thus, the check valve assembly 25 is normally disposed in a closed position relative to the fluid passage 17*a*.

Figure 3:
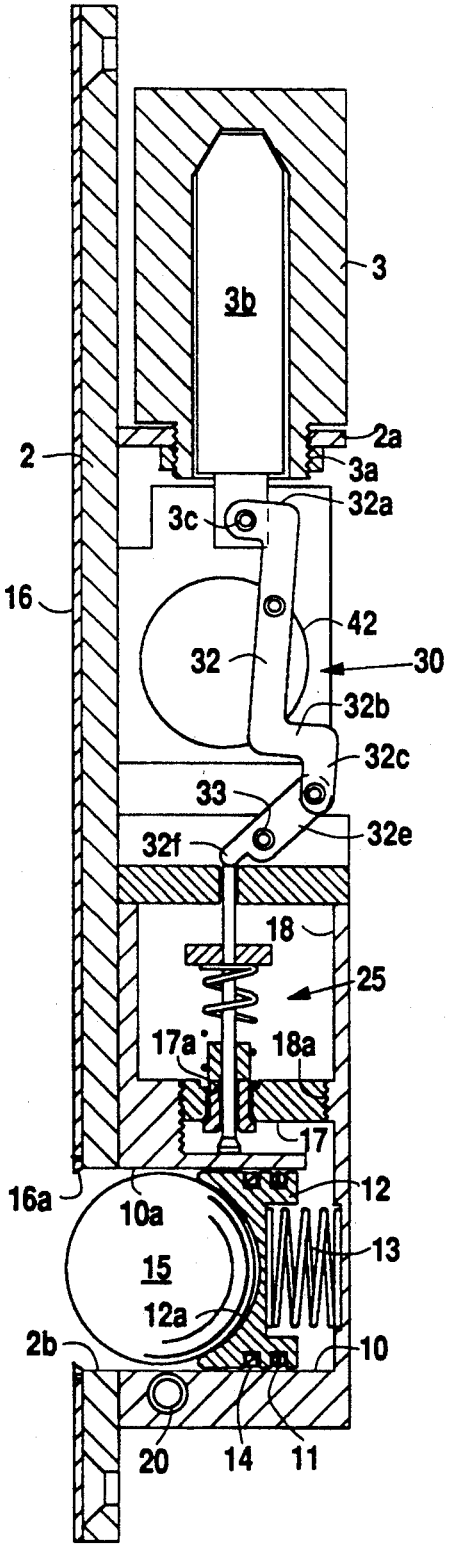
FIG. 3 is a sectional view similar to FIG. 2 but showing the mechanism for operating the locking bolt in the bolt-open position.

A second abutment sleeve 28*e* is secured to the medial portions of the stem 28*a* of the poppet valve 28 and provides a lost motion connection between the poppet valve 28 and the sleeve valve 26 during any downward movement of the poppet valve 28. This construction insures that the initial opening of the valve assembly 25 is accomplished against a relatively small fluid pressure force exerted on the small diameter head portion 28*b* of poppet valve 28. After the poppet valve head 28*b* is disengaged from sealing engagement with the sleeve valve 26, the fluid pressure in the cylinder chamber 10 is rapidly reduced so that when the second abutment 28*e* engages the top of the sleeve valve 26 (as shown in FIG. 3), relatively little additional force is required to effect the disengagement of the sleeve valve 26 from the sealing surface 17*b*, thus providing a relatively large flow area through the fluid passage 17*a*.

Check valve assembly 25 is actuated by a linkage 30 which, in turn, is actuated either by the solenoid core 3*b* or manually by the insertion of a key in a conventional cylinder lock set (not shown) which results in the rotation of a cylindrical element 42 rotatably mounted in the upper portions of the lock body 1.

Thus, linkage 30 includes a generally reverse Z-shaped link 32 having its upper horizontal arm 32*a* pivotally connected to the bottom end of the solenoid core 3*b* by a pin 3*c* and its lower horizontal arm 32*b* having a downward extension 32*c*. The end of extension 32*c* is pivotally connected to one end of a lever 32*e*, medially pivoted on a pin 33 whose lower end 32*f* is in abutting relationship with the top end of the stem 28*a* of poppet valve 28. Thus, as illustrated in FIG. 2, the spring 29 normally biases the linkage 30 to the position illustrated in FIG. 2 wherein the check valve assemblage is in its closed position. The rotation of the cylinder 42 manually by a key, or remotely by energization of solenoid 3, will produce in a counter clockwise rotation of the lock cylinder 42 and result in a downward displacement of the stem portion 28*a* of the poppet valve 28. The poppet valve 28 first opens, as previously mentioned, and then the lost motion connection provided by the second abutment 28*c* moves downwardly into engagement with the sleeve valve 26 to effect the complete opening of the check valve assembly 25, as illustrated in FIG. 3.

The advantages of a locking system embodying the method and apparatus of this invention will be readily apparent to those skilled in the art. When the cylinder chamber 10, the fluid passage 17 and at least a portion of the reservoir chamber 18 are filled with a non-compressible fluid, the outward movement of the piston 12 under the bias of the spring 13 will push the spherical locking bolt 15 to an outwardly projecting position relative to the cover plate 16, as illustrated in FIG. 2, and hence in position to enter the spherical segment recess 20*a* of the striker plate 20 to achieve a dead bolt cooperation therewith. The reduced pressure in cylinder chamber 10 will open check valve assembly 25 to produce fluid flow to fill cylinder chamber 10. Retraction movement of the spherical locking ball is prevented by virtue of the fact that the check valve assembly 25 closes by the fluid pressure produced in any inward movement of piston 12 and spring 29. The piston 12 supporting the spherical locking bolt 15 cannot move inwardly due to the presence of the trapped fluid in the cylinder chamber 10.

To permit the release of the spherical locking bolt 15 from its dead lock position, it is only necessary to turn the lock set cylinder 42 in a counter-clockwise direction by a key, or by remote energization of the solenoid 3 which, through the connecting linkage 30 effects a downward movement of the poppet valve 28, resulting in the complete opening of the check valve assembly 25. When an opening force is applied to the door, the ball 15 will be readily cammed inwardly and the movement of the supporting piston 12 is no longer prevented by the fluid in the cylinder chamber 10 since it can readily flow into the fluid reservoir chamber 18 as a result of the opening of the check valve assembly 25.

With the lock set cylinder 42 maintained in the same position as described for effecting the release of the spherical locking bolt from the dead lock position, the locking system will function as a slam lock. When the door is open, the spherical locking bolt 15 again resumes its projecting position shown in FIG. 2 under the bias of the spring 13 but the check valve assembly 25 remains open. Thus, when the door is slammed to its closed position, the striker plate will engage the spherical locking bolt 15 and cam it inwardly and such inward movement of the supporting piston 12 is not prevented by the fluid in the cylinder chamber 10 due to the fact that the fluid passage 17 is not closed by the check valve assembly 25.

The magnetic band 14 on piston 12 cooperates with a magnetic sensor 20 mounted in the wall of cylinder chamber 10 to produce an electric signal when the locking bolt 15 and piston 12 move between their extended and retracted positions. Such electric signal can be utilized to provide an indication at a remote location of the position of the locking bolt 15. The locking system of this invention is particularly advantageous in that the application of lateral forces to the door such as a force exerted by one individual or by a number of individuals in a panic situation, will, contrary to prior art devices, have no adverse effect on the operation for release of the spherical locking bolt from its dead lock position. The application of lateral forces to the closed door will produce a camming action on the ball forcing it inwardly, but will not produce any binding action on either the key operation of the lock set cylinder 42 or the solenoid operation of such cylinder. By either means, the cylinder 42 can be readily rotated in a counter clockwise direction to open the check valve assembly 25, following which any opening force on the door will cam the spherical locking bolt 15 back into the cylinder chamber 10 without interference from the fluid disposed therein, which flows out through the fluid passage 17 and into the fluid reservoir chamber 18. Thus, the locking system embodying this invention overcomes all of the disadvantages of prior art systems and does not involve any complex linkages or the need for pneumatic or fluid pressure sources. It should be particularly noted that even though the securement of the spherical locking bolt in its dead lock position is accomplished by a hydraulic fluid, there are no hydraulic pumps required to operate the aforedescribed locking system.

Modifications of this invention will be readily apparent to those skilled in the art and it is intended that all such modifications be included within the scope of the appended claims.

What is claimed and desired to be secured by Letters Patent is:

1. A security lock mechanism for use between a movable door having a striker plate and a stationary door frame comprising, in combination:

an elongated housing normally mountable in a door frame with its longitudinal axis vertical;

said housing defining a first fluid chamber having a horizontal axis opening;

a locking bolt slidably and sealably mounted in said horizontal axis opening;

resilient means urging said locking bolt outwardly relative to said opening to a projecting position lockingly engagable with the striker plate;

said housing defining a second fluid chamber having at least a portion thereof disposed vertically above said first fluid chamber;

a fluid passage interconnecting said first fluid chamber with said portion of said second fluid chamber;

a non-compressible fluid filling said first fluid chamber and at least said portion of said second fluid chamber when said locking bolt is in said projecting locking position;

a check valve in said fluid passage having a normally closed position preventing fluid flow from said first fluid chamber to said second fluid chamber, thereby maintaining said locking bolt in said projecting locking position; and means for shifting said check valve from said closed position to an open position, thereby permitting said locking bolt to be moved inwardly in said opening to an unlocked position.

2. The apparatus of Claim 1 wherein said means for shifting said check valve comprises a lock set operated cylinder mounted in said housing for rotational movement by a key between a locking position and an unlocking position; and linkage means interconnecting said lock set cylinder and said check valve to move said check valve to an open position only in said unlocking position of said lock cylinder.

3. The apparatus of Claim 1 further comprising an electric solenoid mounted on said housing and having a core shiftable to an unlocking position by said solenoid; and means operatively connecting said solenoid core to said check valve to open said check valve only when said solenoid core is shifted to its said unlocking position.

4. The apparatus of Claim 2 further comprising an electric solenoid mounted on said housing and having a core shiftable to an unlocking position by energization of said solenoid; and second linkage means operatively connecting said solenoid core to said check valve to open said check valve only when said solenoid core is shifted to said unlocking position.

5. The apparatus of Claim 4 wherein said second linkage means comprises a pivot link connecting said solenoid core to said lock set cylinder whereby actuation of said solenoid shifts said lock set cylinder to its said unlocking position to open said check valve.

6. The apparatus of Claim 1 wherein the striker plate defines a locking bolt receiving recess;

said locking bolt comprises a cylindrical piston slidably and sealably mounted in said horizontal axis opening of said elongated housing;

said cylindrical piston having an outer face contoured to define a semispherical recess; and a ball mounted in said semi-spherical recess and projecting horizontally outwardly from said elongated housing to cooperate with said lock bolt receiving recess in said striker plate to dead lock said door when said check valve is in its said closed position.

7. The apparatus of Claim 1 wherein said check valve comprises an annular valve seating surface in said fluid passageway;

a sleeve valve element having an external annular surface axially movable into sealing relationship with said annular valve seating surface, and an internal valve seating surface;

a second valve element comprising a valve head axially movable into sealing relationship with said internal valve seating surface of said sleeve valve element and an elongated valve stem traversing the bore of said sleeve valve element;

resilient means axially biasing said valve stem in the direction to sequentially engage said valve head with said internal valve seating surface of said sleeve valve element and then engage said sleeve valve element in sealing engagement with said annular valve seating surface of said fluid passageway; and lost motion connection means between said valve stem and said sleeve valve element effective upon axial movement of said valve stem in the direction opposing said resilient means to first disengage said valve head from said internal valve seating surface of said valve sleeve element and then disengage said external annular surface of said valve sleeve element and then disengage said external annular surface of said valve sleeve element from said annular valve seating surface in said fluid passageway, thereby reducing the amount of force required to open said fluid passageway.

8. A remotely operated door locking system for use in effecting locking or unlocking of a door having a striker plate relative to a cooperatively positioned door frame, the system comprising:

an elongated lock housing mountable in an edge of the door frame;

said housing defining an operating fluid chamber having a cylindrical opening adjacent the door frame edge;

a locking bolt slidably and sealably mounted in said cylindrical opening;

resilient means for urging said locking bolt outwardly relative to said cylindrical opening to cooperate with the striker plate;

said housing further defining a fluid reservoir chamber;

means defining a fluid passage between said operating fluid chamber and said fluid reservoir chamber;

a non-compressible fluid filling said operating fluid chamber, said fluid passage, and at least a portion of said fluid reservoir chamber when said locking bolt is disposed in said outward position engaging the striker plate;

check valve means normally preventing fluid flow through said fluid passage only from said fluid reservoir chamber to said operating fluid chamber; and remotely operated means for shifting said check valve to permit flow through said fluid passage from said operating fluid chamber to said fluid reservoir chamber, thereby permitting said locking bolt to be moved inwardly in said opening to disengage from the striker plate.

9. The apparatus of claim 8 wherein said remotely operated means for shifting said check valve comprises a solenoid mounted on said housing and having a core shiftable by energization of said solenoid; and linkage means for operatively connecting said core to said check valve to shift said check valve to permit fluid flow from said operating fluid chamber to said fluid reservoir chamber.

10. The apparatus of claim 9 further comprising a key operable cylinder rotatably mounted in said elongated housing and operatively connected to said linkage means to permit shifting of said check valve to said open position to permit release of said locking bolt from the striker plate.

11. The apparatus of claim 6 further comprising means on said elongated housing limiting the outward movement of said ball.

12. The apparatus of claim 8 further comprising means on said elongated housing for limiting outward movement of said locking bolt.

13. The apparatus of claim 8 wherein said check valve means comprises an internal, annular sealing surface in said fluid passage;

a sealing sleeve having a body portion insertable in said fluid passage to define an annular passage therethrough;

said sealing sleeve having an external annular shoulder co-operable with said annular internal sealing surface in said fluid passage in sealing relation;

said sealing sleeve also defining an internal annular sealing surface;

a poppet type valve having a stem portion extending through the bore of said sealing sleeve and an enlarged head portion co-operable with said internal annular sealing surface in said sealing sleeve to close off fluid flow through the bore of said sealing sleeve, whereby fluid pressure in said operating fluid chamber in excess of the fluid pressure in said fluid reservoir chamber will produce axial movement of both said sealing sleeve and said poppet valve into said fluid passage to seal off said fluid passage;

said stem portion of said poppet valve extending entirely through said sealing sleeve and being connected to said remotely operated means; and an abutment on said stem portion of said poppet valve forming a lost motion connection with said sealing sleeve, whereby said poppet valve is first unseated from said sealing sleeve by said remotely operated means and then said sealing sleeve is disengaged from said annular internal sealing surface in said fluid passage to provide a large flow area for fluid to pass through said fluid passage by application of a relatively small force to said poppet valve.

14. The apparatus of claim 13 further comprising resilient means biasing said poppet valve to its sealing position relative to said annular internal surface of said sealing sleeve, thereby biasing said sealing sleeve toward engagement with said annular internal surface of said fluid passage.

15. The method of controlling the position of a lock bolt relative to a cooperative striker plate comprising the steps of:

forming the lock bolt as a portion of a piston;

slidably and sealably mounting said piston in a first fluid chamber for movement between a locking and unlocking position relative to the striker plate;

resiliently biasing said piston outwardly relative to said first fluid chamber to engage said lock bolt with said striker plate;

providing a second fluid chamber and a fluid passage communicating between said first and second fluid chambers;

filling the first fluid chamber, the fluid passage and at least a portion of the second fluid chamber with a non-compressible fluid when said piston is in its outward position; and controlling the flow of fluid through said fluid passage to alternatively lock said lock bolt in engagement with said striker plate by fluid trapped in said first fluid chamber, or to permit said lock bolt to move out of engagement with said striker plate by permitting fluid flow from said first fluid chamber through said passage and into said second fluid chamber.

16. The method of claim 15 wherein the control of fluid flow through said fluid passage is accomplished by remote energization of a solenoid to operate a valve in said fluid passage.

17. The method of claim 15 wherein the control of fluid flow through said fluid passage is accomplished manually by turning a key to mechanically operate a valve in said fluid passage.

18. The method of claim 15 further comprising the step of forming the portion of the lock bolt that cooperates with the striker plate by a hard metal ball; and forming the lock bolt receiving recess in the striker plate as a spherical segment surface, whereby lateral forces applied to the lock bolt will produce forces on said ball in the direction to disengage from said striker plate recess.

19. Apparatus for dead bolt locking a movable door having keeper and a stationary door frame comprising:

a housing mountable on said door frame;

said housing defining a cylindrical bore having an opening facing said keeper in the closed position of said door;

a spherical locking element co-operable with said keeper;

support means slidably mounted in the bore of said cylinder and abutting said spherical locking element;

resilient means biasing said support means in an outward direction relative to said cylindrical bore opening to a locking position wherein said spherical locking element is positioned in locking engagement with said keeper in the closed position of said door, and means for selectively preventing movement of said support means inwardly in said cylindrical bore from said locking position; said means for selectively preventing inward movement of said support means comprising a non-compressible fluid filling said cylinder bore inwardly of said support means; said housing defining a fluid exit from said cylinder bore; and a selectively operable valve for opening and closing said fluid exit.

20. The apparatus of claim 19 further comprising:

a key operated shiftable member mounted in said housing; and linkage means operatively connecting said shiftable member to said selectively operable valve.

21. The apparatus of claim 19 further comprising:

a solenoid mounted on said housing and having a shiftable core; and linkage means operatively connecting said solenoid core to said selectively operable valve.

* * * * *

UNITED STATES PATENT AND TRADEMARK OFFICE

CERTIFICATE OF CORRECTION

PATENT NO. : 5,177,988

DATED : January 12, 1993

INVENTOR(S) : Raymond B. Bushnell

It is certified that error appears in the above-indentified patent and that said Letters Patent is hereby corrected as shown below:

On the title page, insert the following:

[73] Assignee: Southern Steel, A Division of Phelps-Tointon, Inc.
San Antonio, Texas Signed and Sealed this Tenth Day of May, 1994

Bruce Lehman

*Attest:*

BRUCE LEHMAN

*Attesting Officer*

*Commissioner of Patents and Trademarks*